US006394285B1

(12) United States Patent
Arthurs et al.

(10) Patent No.: US 6,394,285 B1
(45) Date of Patent: May 28, 2002

(54) DISHWASHER ACCESSORY FOR SECURING AND SUPPORTING STEMWARE

(76) Inventors: Michelle Smith Arthurs; Brandon Blair Arthurs, both of 3504 Tree Top Way, Wilmington, NC (US) 28409

( * ) Notice: Subject to any disclaimer, the term of this patent is extended or adjusted under 35 U.S.C. 154(b) by 0 days.

(21) Appl. No.: 09/516,006

(22) Filed: Feb. 29, 2000

(51) Int. Cl.[7] ..... A47F 7/00
(52) U.S. Cl. ..... 211/41.9; 248/316.7
(58) Field of Search ..... 211/41.9, 41.8, 211/37.3, 37.6; 248/316.7

(56) References Cited

U.S. PATENT DOCUMENTS

| | | | | | |
|---|---|---|---|---|---|
| 1,643,661 | A | | 9/1927 | Kendall | 248/229.26 |
| 1,664,415 | A | | 4/1928 | Herzog | 248/229.26 |
| 2,523,785 | A | | 9/1950 | Sereno | 248/229.26 |
| 3,228,640 | A | | 1/1966 | Wolsh | 248/229.26 |
| 3,289,854 | A | | 12/1966 | Kauffman | 211/41 |
| 3,318,457 | A | | 5/1967 | Krasnoff | 211/74 |
| 3,451,556 | A | | 6/1969 | Macoicz | 211/41 |
| 3,521,332 | A | | 7/1970 | Kramer | 24/81 |
| 3,612,285 | A | | 10/1971 | Mason | 211/41 |
| 3,752,322 | A | | 8/1973 | Fiocca et al. | 211/41 |
| 3,907,239 | A | | 9/1975 | Ehrlich | 248/229 |
| 3,989,213 | A | | 11/1976 | Allen | 248/214 |
| 4,121,798 | A | | 10/1978 | Schumacher et al. | 248/113 |
| 4,589,556 | A | | 5/1986 | Peretz | 211/41 |
| 4,635,799 | A | | 1/1987 | Penner | 211/41 |
| 4,707,892 | A | | 11/1987 | Nelson | 24/336 |
| 4,787,591 | A | | 11/1988 | Villacorta | 248/316.7 |
| 4,917,248 | A | * | 4/1990 | Friskney | 211/41 |
| 4,927,033 | A | | 5/1990 | Patera et al. | 211/41 |
| 4,974,806 | A | | 12/1990 | Matern | 248/499 |
| 5,038,430 | A | | 8/1991 | Bly | 5/425 |
| 5,042,769 | A | | 8/1991 | Smed | 248/231.8 |
| 5,249,590 | A | | 10/1993 | Jacobus et al. | 134/135 |
| 5,288,047 | A | | 2/1994 | Pan | 248/229 |
| 5,351,920 | A | | 10/1994 | Decky et al. | 248/73 |
| 5,371,991 | A | | 12/1994 | Bechtel et al. | 52/686 |
| 5,405,018 | A | * | 4/1995 | Anthrop, Jr. | 211/13 |
| 5,555,607 | A | | 9/1996 | Parveris | 24/129 R |
| 5,697,591 | A | | 12/1997 | Cooper | 248/229.16 |
| 5,772,166 | A | | 6/1998 | Adams | 248/231.81 |
| 5,918,749 | A | * | 7/1999 | Pille et al. | 211/41.9 |

* cited by examiner

*Primary Examiner*—Daniel P. Stodola
*Assistant Examiner*—Khoa Tran
(74) *Attorney, Agent, or Firm*—Michael E. Mauney

(57) ABSTRACT

An elongated durable corrosion resistent dishwasher accessory for securing and supporting stemware in a dishwasher rack. At one end of the dishwasher accessory is a C-shaped clip for connecting to a horizontal wire stringer on a dishwasher rack. At that same end of the dishwasher accessory is a bore that allows a vertical wire stringer to pass within the bore to secure the dishwasher accessory to the dishwasher rack. At the opposite end of the dishwasher accessory is two oppositely positioned gripper jaws with various sized bores therein. These bores clip around the stem of a piece of stemware, which secures the stemware in a vertical downward position within a dishwasher rack when the dishwasher accessory is secured to the wire stringer. This allows the washing streams of water to securely wash the liquid retaining portion of the stemware without upsetting or turning over the stemware in the dishwasher rack. The dishwasher accessory adjusts to different size and different heights of stemware, is durable, simple to construct, and easy to operate.

2 Claims, 4 Drawing Sheets

DISHWASHER ACCESSORY FOR SECURING AND SUPPORTING STEMWARE

FIELD OF THE INVENTION

This invention relates to an accessory to be used in an automatic dishwasher. More particularly, it relates to a mechanism which will adjustably attach to a portion of a dishwasher rack at one end and adjustably attach to the stem of stemmed glassware at the other end to hold the stemmed glassware in an upright and secure position within the rack of the dishwasher.

BACKGROUND OF THE INVENTION

Automatic dishwashers, especially those designed for home use, accomplish the washing and rinsing of glasses, cups, and the like by spraying pressurized streams of water mixed with a detergent over the glassware. Unlike some commercial dishwashers, which may be designed for a particular item, home dishwashers are used for items as diverse as large pots down to small finger sized glasses used for specialized liqueurs. Consequently, the racks within the dishwasher are designed for broad utility for holding a wide variety of items in a dish rack during the spraying action generated by the dishwasher. However, for the dishwashing action to be effective, the stream of the water must have enough pressure to dislodge dried food particles from the items to be washed. This pressure can upset light items such as crystal glassware and especially such items with a high center of gravity like stemware where a large portion of the weight of the item may be in its base and its stem rather than in the liquid retaining bowl. Consequently, these items tend to get dislodged from their position in the rack of the dishwasher.

If the item is dislodged, it may break. Secondly, if the item is lying on its side, the cup of the stemware may collect a pool of dishwasher water. This pool of water sometimes is dirty. This requires that the stemware be hand washed. Even if the water is not dirty, the stemware must be hand dried. These occurrences decrease the utility of the dishwasher. There is a need for a simple inexpensive device to remedy those deficiencies of a home dishwasher.

A variety of items have been suggested to hold stemware glasses or other unstable items in the appropriate position in the dishwasher while in use. For example, Kauffman, U.S. Pat. No. 3,289,854 discloses a spring-like item to be mounted on an upright rod within a rack of a dishwasher. A glass or similar item is then inserted between the spring-like item and the upright rod in the dishwasher rack. The spring is biased to hold the glassware into a secure position against the upright rod in the dishwasher rack. A similar design is seen in Patera et al., U.S. Pat. No. 4,927,033. The Jacobus et al., U.S. Pat. No. 5,249,590 again uses a spring to provide a biasing pressure against an item to hold it into place. Unlike the Kauffman '854 and Patera '033 patents, in Jacobus et al patent '590 the spring is biased in a downward direction and exerts a downward pressure, rather than a lateral pressure on the item to be held in place.

A slightly different concept is seen in the Mason, U.S. Pat. No. 3,612,285 and the Fiocca et al, U.S. Pat. No. 3,752,322. In both these patents a moveable wire rack assembly folds into place against items to be secured in the top rack of a dishwasher placing an oblique sideways and downward pressure against the items to secure them into place.

A third approach is seen in Peretz, U.S. Pat. No. 4,859,556. There, a free-standing accessory wire rack is secured into position against the bottom rods of the dishwasher. An assembly extends upward a sufficient distance to allow clearance for a stemmed piece of glassware. At the top of the assembly there is a wire mechanism to allow insertion of the stem of the glassware and a downwardly biasing clip to exert pressure against the base of the glassware to hold it into place and suspend it above the bottom support wires in the dishwasher rack. A second embodiment of the Peretz '556 is part of the rack design already present in the dishwasher when purchased, but would otherwise work the same as the first described add-on accessory embodiment.

A very wide variety of general clamping devices are known. These devices have not been used in the application of holding stemware in an upright position in a dishwasher and are far afield from the need this invention is designed to meet. Different types of clamps are widely used to hold together pieces of pipe, wire, cable, and the like. For example, Kramer, U. S. Pat. No. 3,521,332 discloses a double-ended clip that can be used to grip articles in a side-by-side relationship. Wolsh, U. S. Pat. No. 3,228,640 discloses a pipe support clip, which is used to support pipes or conduits to angle iron trusses in buildings that use angle iron trusses to support floors or ceilings. Villacorta, U. S. Pat. No. 4,787,591 discloses a flexible laboratory clamp. This is designed to be used in laboratory applications where a person may have only one hand available to remove or secure an object to the clamp. Virtually every piece of stemmed glassware will have a bowl to hold the liquid and a flat base on which the stemware rests when in use. The specific design parameters of stemmed glassware make it difficult to use a generalized clamp such as disclosed by Villacorta, Wolsh, or Kramer. Insofar as it is possible, it is desirable to hold glassware bowl so that it will directly face the stream of water used in a dishwasher to wash the bowl. The flat base of the stemware means that ordinarily it cannot be secured immediately adjacent to the rack of the dishwasher. Moreover, glassware comes in such a variety of shapes and sizes that provision must be made in a design to not only adjustably fit the different sized stems on glassware, but also to allow variation in the point of attachment along the stem of a glassware to appropriately support glassware in the desirable upright position in the rack of a dishwasher.

Despite the above described patents, none have proven practical in application or are widely adoptable to different designs of dishwashers and dishwasher racks. Consequently, there is still a need for a simple, inexpensive, practical accessory to accomplish the purpose of adjusting to hold different types of stemmed glassware in the correct position during a dishwashing cycle in a home dishwasher.

SUMMARY OF THE INVENTION

The present invention is directed toward a simple one piece accessory designed to support stemmed glassware into an upright position in the rack of a dishwasher. It will work equally well in the top or bottom rack. At one end of the stemware support invention, there is a gripper assembly designed to fit around and grip the stem of glassware. It is designed so that it will grip the stem securely, but not tightly. Stemmed glassware is found in a variety of sizes and shapes ranging from quite small liqueur glasses to quite large beer steins, water goblets, and the like. Thus, the gripper assembly of the stemware support invention adjusts to different diameter stems found in most different types of stemmed glassware.

In a spaced relation from the stemware gripper at the opposite end of the stemware support invention is an attachment device for affixing the stemware support invention to a wire stringer comprising a portion of the rack of a dishwasher. This attachment is designed to easily attach and detach from a wire stringer member of the rack of a dishwasher. It will easily attach to vertical free-standing wire support pieces in the dishwasher or will attach to horizontal wire stringers usually found along the edge of the rack. The attachment to the wire stringer will move up and down on a vertical wire stringer and rotate on a horizontal wire stringer, both movements for vertical adjustment.

When one wishes to affix a stemmed glass in the rack of a dishwasher, one would first find the appropriate space in the rack of the dishwasher, affix the stemware support invention to a wire stringer of the dishwasher rack, then insert the stem of the glassware into the gripper at the opposite end of the stemware support invention from the end which is attached to the dishwasher rack. The stemmed glassware will then be supported in an upright position with its bowl facing down into the flow of the stream of water and detergent typically directed upwardly from the water distribution means present in the dishwasher. The dishwasher is then closed and the dishwashing cycle is begun. When the cycle is finished and the stemmed glassware is to be removed from the dishwasher and placed into a cabinet or other storage area, the process is simply reversed. The glassware is first removed from the invention then the invention may be removed from the dishwasher. When the dishwasher is needed for such things such as coffee cups, bowls, or the like which do not require the aid of this invention, then the invention may be stored along with other kitchen accessory items in an appropriate storage area such as a drawer, cabinet, tool box, or the like. Because the invention will be constructed from a durable corrosion resistant material, it may be left in the dishwasher rack. It will not interfere with the use of the rack for other items, even if the invention is not in use.

DETAILED DESCRIPTION OF THE DRAWINGS

Figure 1:
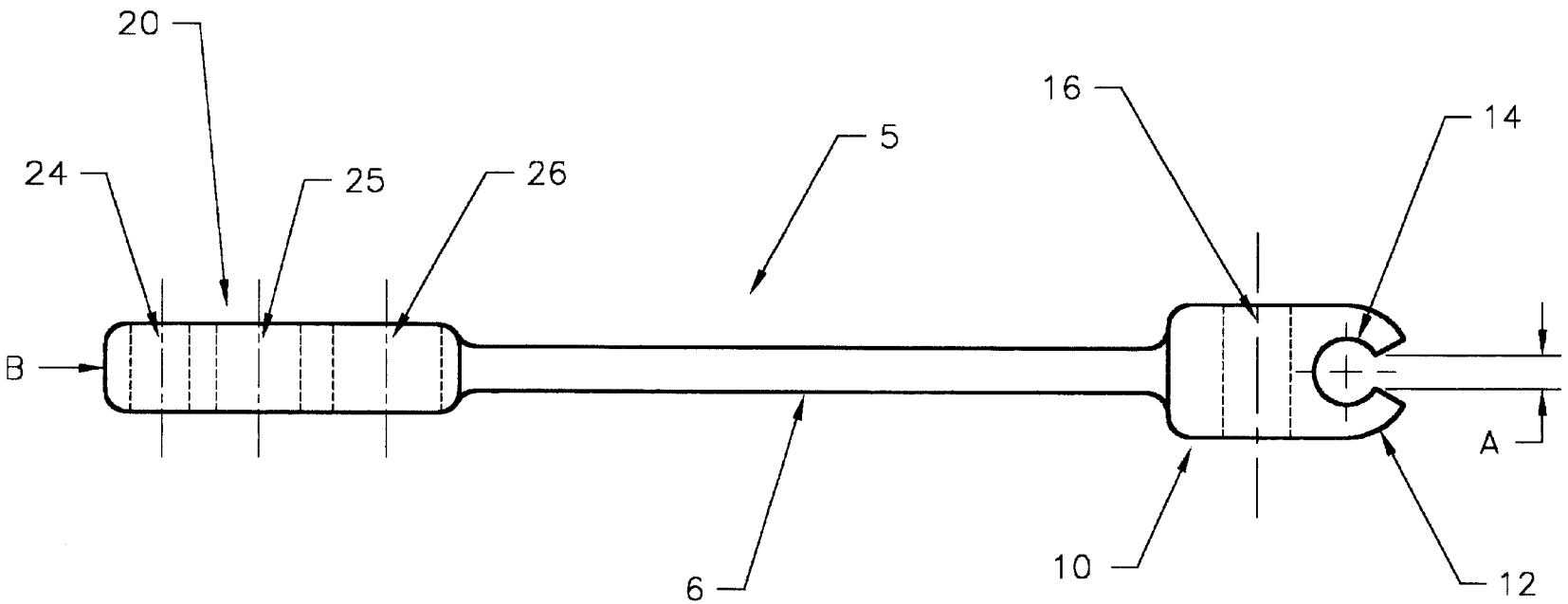
FIG. 1 shows the current invention when seen from the side.

FIG. 1 shows the current stemware support accessory (5) as seen from the side. The stemware support accessory (5) is constructed of a flexible, resilient, non-corrosive material. A number of thermoplastic resins are suitable for constructing the stemware support accessory (5), but it could be made of materials as diverse as wood or stainless steel. At one end of the stemware support accessory (5) is a gripper assembly (20). The gripper assembly (20) grips the stem of a piece of stemmed glassware to hold the glassware in an upright position. At another second end of the stemware support accessory (5) is an attachment assembly (10). The attachment assembly (10) is designed to attach to both horizontal wire stringers of a dishwasher rack as well as vertical wire pieces of a dishwasher rack. The gripper assembly (20) and the attachment assembly (10) are necessarily spaced apart from each other and connected by an elongated connecting member (6). The elongated member (6) may vary in length from one embodiment to another but will ordinarily be at least one inch in length to allow the necessary adjusting movements.

Figure 2:
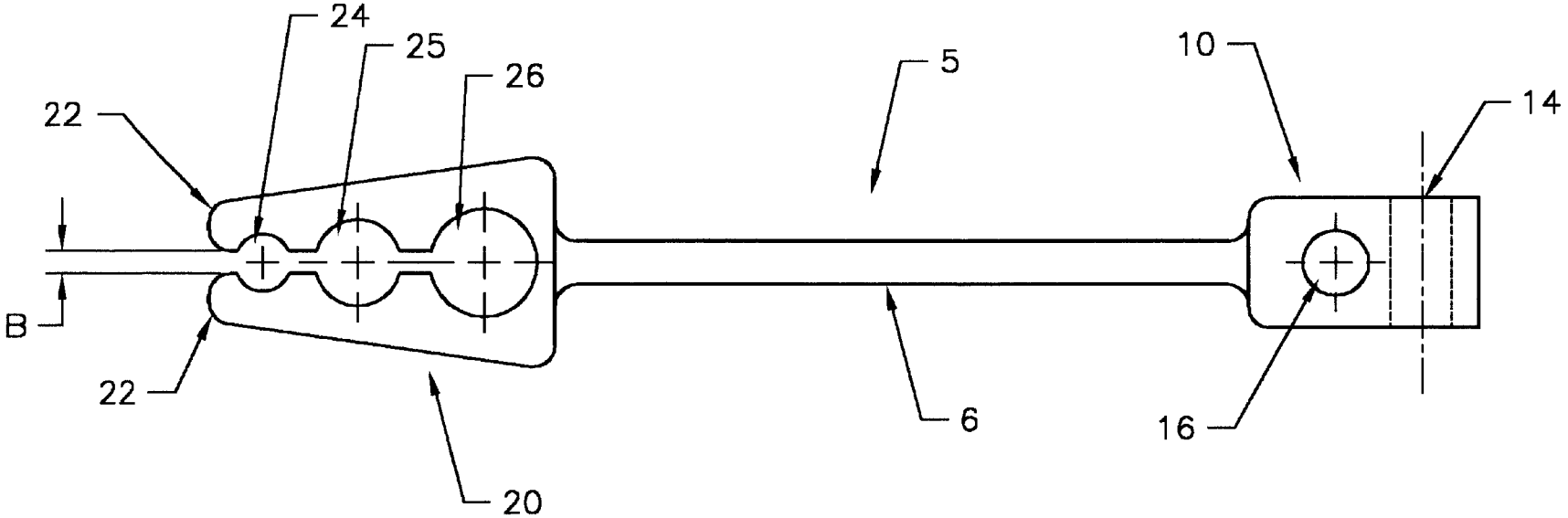
FIG. 2 shows the current invention when seen from above.

At the end of the gripper assembly (20) is a gripper opening (B). This gripper opening (B) is best seen in FIG. 2 where the gripper assembly (20) is seen from above. The gripper opening (B) extends into a first stemware support bore (24), a second larger stemware support bore (25) and a third largest stemware support bore (26). The stemware support bores (24, 25, 26) are seen as dotted lines in FIG. 1.

The attachment assembly (10) has an attachment opening (A) forming a C-shaped clip (12). A horizontal wire stringer of a dishwasher rack will slip into the C-shaped clip (12) through the attachment opening (A) and be secured in the C-shaped clip bore (14). The attachment opening (A) will ordinarily will be somewhat smaller than the diameter of wire stringers used in dishwasher racks while the C-shaped clip bore (14) will be somewhat larger in diameter than the diameter of a wire stringer. Because the stemware support accessory (5) is made of flexible materials, the C-shaped clip (12) will flex open to allow admission through the attachment opening (A) into the C-shaped clip bore (14) of a horizontal wire stringer on a dishwasher rack. Once the C-shaped clip (12) is clipped over a horizonal wire stringer in a dishwasher rack it will be held there by the flexible resilient material of which the stemware support accessory (5) is constructed. A vertical wire enclosed bore (16) is seen in dotted lines behind and spaced apart from the C-shaped clip (12). The diameter of the vertical wire enclosed bore (16) will be somewhat larger than the diameter of vertical wire stringers ordinarily found in home dishwashers. One end of a vertical wire stringer will slip into the vertical wire enclosed bore (16) and gravity will hold the stem ware support accessory (5) in place during use.

FIG. 2 is the stemware support accessory (5) seen from above. The gripper assembly (20) is seen more clearly in this view. At one end of the gripper assembly (20) is the gripper opening (B) between two oppositely positioned jaws (22). The gripper opening (B) leads to a first stemware support bore (24), a second larger stemware support bore (25), and a third largest stemware support bore (26). There are variations in size in the stem of various stemmed glassware. The successively larger stemware support bores (24, 25, 26) make provision for variation in the size of the diameter of the stem of stemmed glassware, thus, increasing the utility of the stemware support accessory (5). However, the gripper opening (B) is designed to be smaller than almost all diameters of stemmed glassware. The flexible resilient material of which the stemware support accessory (5) is constructed will allow the stem of glassware to slip through the gripper opening (B) and be secured in the appropriate stemware support bore (24, 25, or 26). Smaller stems will go into the smallest stemware support bore (24), larger stems into the larger stemware support bore (25), and the largest stems will go into the largest stemware support bore (26).

The attachment assembly (10) is at the opposite end of the stemware support accessory (5) from the gripper assembly (20). The attachment assembly (10) is separated from the gripper assembly (20) by the elongated member (6). Seen more clearly in FIG. 2 is the vertical wire enclosed bore (16). How the gripper assembly (20) and the attachment assembly (10) are used to support stemware in an upright position in a dishwasher rack is seen in FIG. 3.

Figure 3:
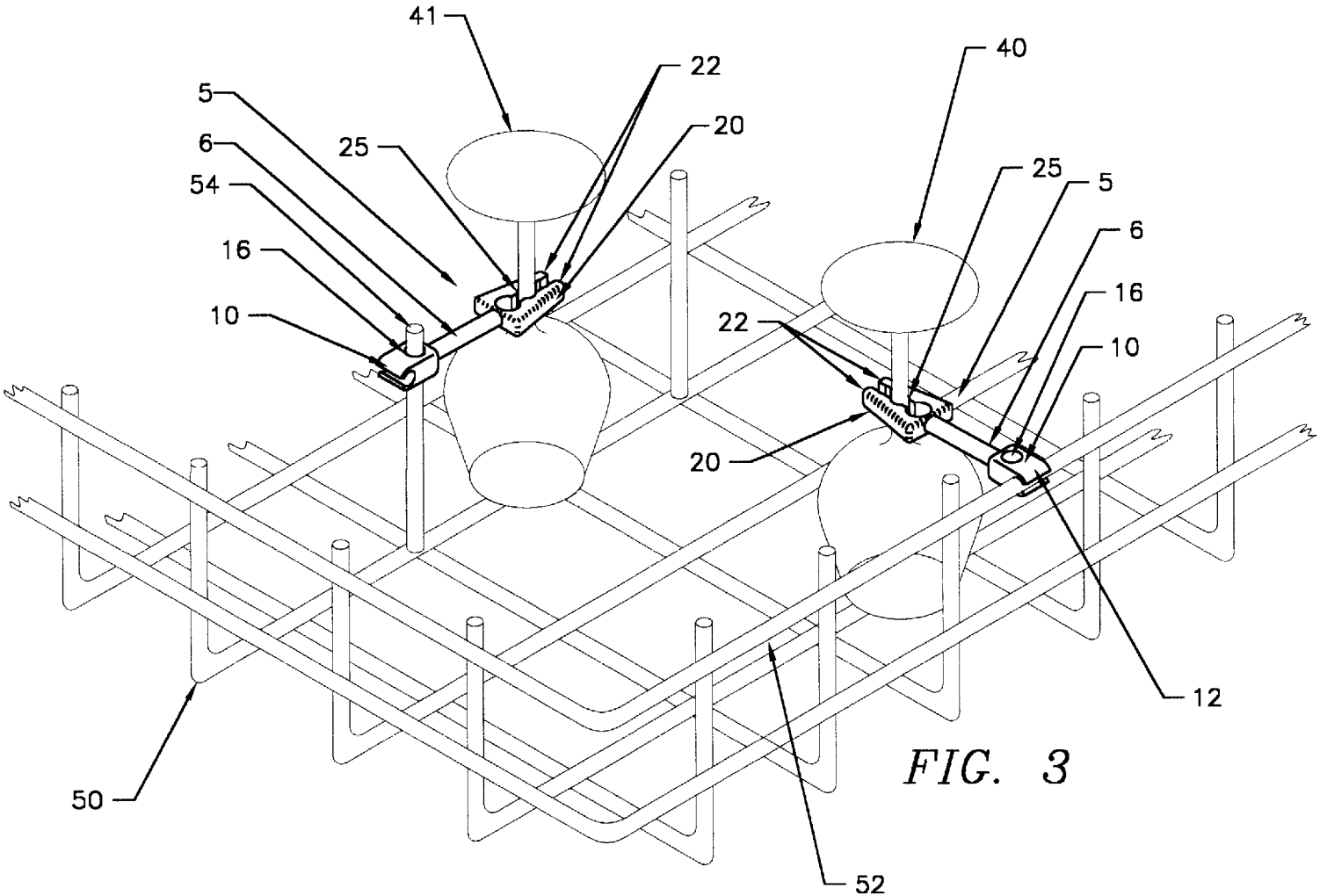
FIG. 3 shows the current invention supporting stemware in a dishwasher rack.

Two stemmed wine glasses of ordinary design are seen in FIG. 3. A dishwasher rack (50) is shown with both horizontal wire stringers (52) and vertical wire stringers (54). This dishwasher rack (50) is shown in somewhat idealized form to better demonstrate the functioning of the stemware support accessory (5). One piece of glassware (40) is shown supported by the stemware support accessory (5) by securing the stemware support accessory (5) to a horizontal wire stringer (52) by means of the C-shaped assembly (12). This C-shaped assembly (12) is shown clipped over and around the horizontal wire stringer (52). This allows the stem ware support accessory (5) to move in an arc with the elongated member (6) defining the radius of a circle of motion with the horizontal wire stringer (52) as the center of the circle. This allows vertical adjustment of the stemware support accessory (5) as it moves through a cord of an arc of motion of the stemware support accessory (5). The stemmed wine glass (40) is shown positioned within the gripper assembly (20) and more specifically held between the oppositely positioned jaws (22) and secured in the second larger stemware support bore (25).

Also shown in FIG. 3 is a second stemmed wine glass (41) supported by the stemware support accessory (5) on a vertical wire stringer (54). Here, the wire stringer (54) is passed through the vertical wire enclosed bore (16) so that the stemware support accessory (5) is held into place by gravity. Again, the wine glass (41) is positioned in the gripper assembly (20) in the larger bore (25) between the two oppositely positioned jaws (22). The stemware support accessory (5) may be adjusted vertically on the vertical wire stringer (54) by the vertical wire enclosed bore (16) and the stemware support bore (25) by moving the stemware support accessory (5) up or down on the vertical wire stringer (54) and the stem of the wine glass (41). The adjustment to different sized stemmed glassware will be seen more clearly in FIG. 4.

Figure 4:
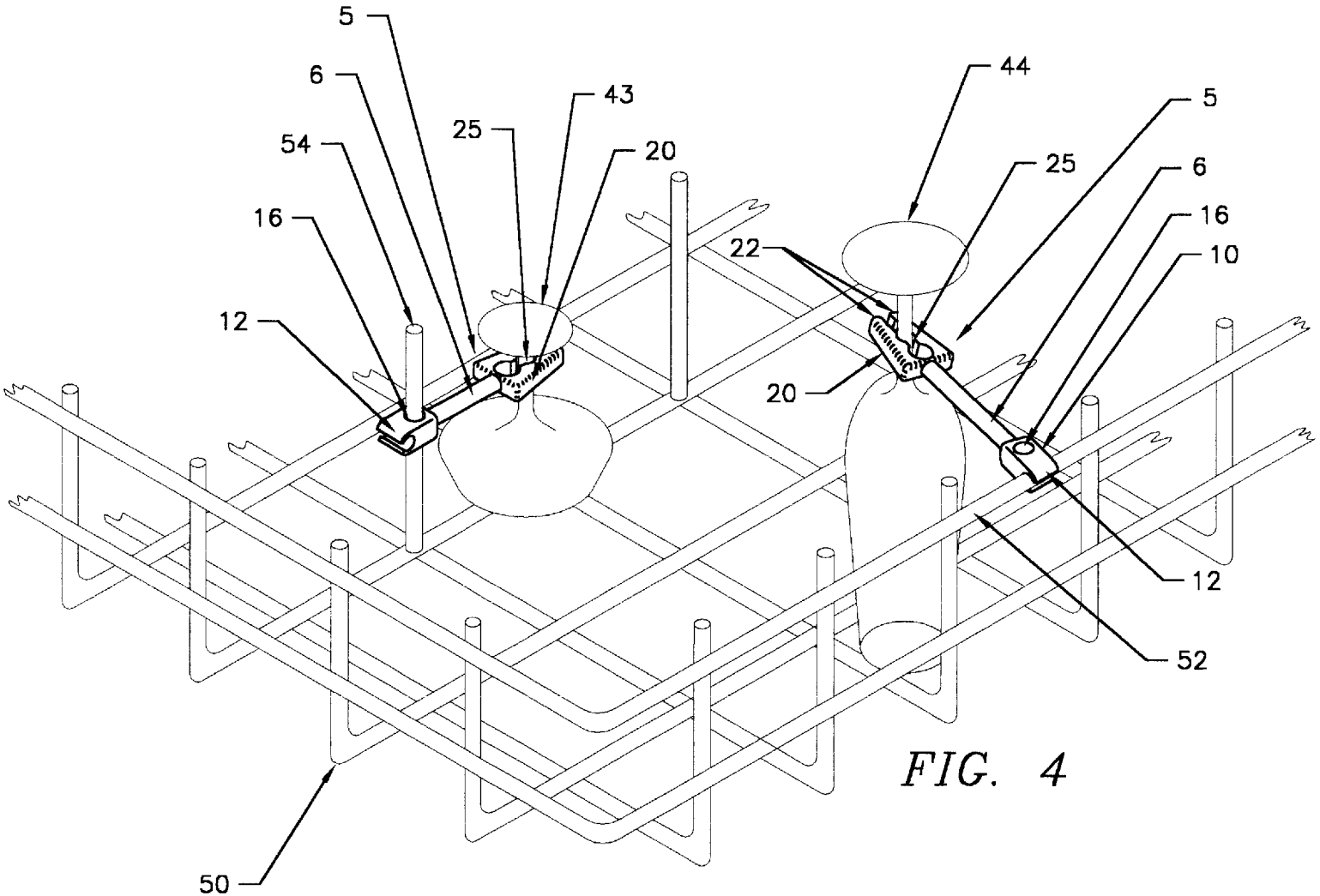
FIG. 4 shows the current invention supporting different size stemware in a dishwasher rack.

In FIG. 4 a small desert liqueur goblet (43) is shown supported by the stemware support accessory (5) on a vertical wire stringer (54). Because the dessert liqueur goblet is much smaller, the stemware support accessory (5) is positioned much lower on the vertical wire stringer (54) so that the second stemware support bore (25) can attach to the much lower stem on the dessert liqueur goblet (43). A tall champagne glass (44) is shown attached to a horizontal wire stringer (52) by the stemware support accessory (5). Here, the C-shaped clip (12) of the attachment assembly (10) is attached to the horizontal wire stringer (52). However, the stemware support accessory (5) is no longer horizontal as shown in FIG. 3 but angled upward along a cord of an arc so that the gripper assembly (20) can attach to the higher stem of the champagne glass (44). The separation of the gripper assembly (20) and the attachment assembly (10) by the elongated member (6) allows the rotating motion for adjustment to different points of attachment for different heights stemware. The oppositely positioned jaws (22) of the gripper assembly (20) are attached around the stem of the champagne glass (44) which is secured in the second larger stemware support bore (25). FIG. 4 illustrates how the stemware support accessory (5) can readily adjust to different size and heights of stemmed glassware to still securely support them in a dishwasher rack (50).

We claim:

1. A method for supporting different sized stemware in an upright position in a dishwasher rack comprising:

(a) forming an elongated member;

(b) adjustably attaching a first end of said elongated member to a wire stringer in a dishwasher rack whereby a second end of said elongated member will freely move in a vertical direction while restrained from movement in a horizontal direction;

(c) adjustably attaching said second end of said elongated member to different sized diameter stems of glassware.

2. A method for supporting different sized stemware in an upright position in a dishwasher rack of claim 1 wherein said step of forming an elongated member forms an elongated member of at least one inch in length.

* * * * *